US011090572B2

(12) United States Patent
Sornik

(10) Patent No.: US 11,090,572 B2
(45) Date of Patent: Aug. 17, 2021

(54) AMUSEMENT RIDE

(71) Applicant: MACK RIDES GMBH & CO. KG, Waldkirch (DE)

(72) Inventor: Frank Sornik, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 0 days.

(21) Appl. No.: 16/753,229

(22) PCT Filed: Jul. 12, 2018

(86) PCT No.: PCT/EP2018/068865
§ 371 (c)(1),
(2) Date: Apr. 2, 2020

(87) PCT Pub. No.: WO2019/081077
PCT Pub. Date: May 2, 2019

(65) Prior Publication Data

US 2020/0324212 A1 Oct. 15, 2020

(30) Foreign Application Priority Data

Oct. 27, 2017 (DE) ..... 10 2017 125 288

(51) Int. Cl.
*A63G 27/00* (2006.01)
*A63G 31/00* (2006.01)

(52) U.S. Cl.
CPC ..... *A63G 27/00* (2013.01); *A63G 31/007* (2013.01)

(58) Field of Classification Search
CPC ..... A63G 27/00; A63G 27/08; A63G 31/00; A63G 31/007; A63G 1/00; A63G 1/08; E04H 1/00; E04H 1/44
USPC ..... 472/13, 29, 30, 32, 44–47, 128; 4/506, 4/508, 509
See application file for complete search history.

(56) References Cited

U.S. PATENT DOCUMENTS 989,280 A 4/1911 Palmer
1,731,532 A * 10/1929 Hoppes ..... A63G 9/00 482/26

(Continued)

FOREIGN PATENT DOCUMENTS

CN 106457050 A 2/2017
DE 2811614 A1 9/1979

(Continued)

OTHER PUBLICATIONS

Office Action dated Jun. 12, 2018, in parallel German patent application No. 102017125288.6.
International Search Report dated Nov. 15, 2018, of PCT/2018/068865.
Examination and Search report completed Jan. 11, 2021 for corresponding application in Australia 2018355629.

(Continued)

*Primary Examiner* — Kien T Nguyen
(74) *Attorney, Agent, or Firm* — Nath, Goldberg & Meyer; Jerald L. Meyer

(57) ABSTRACT

An amusement ride having at least one vehicle, which comprises one or more passenger compartments for accommodating passengers, and a pool, wherein the amusement ride is designed in such a way that at least one pendulum movement of the vehicle is possible, wherein the amusement ride is configured in such a way that the pool can be at least partially filled with a liquid and the vehicle comes into contact with the liquid of the pool in the course of the pendulum movement.

18 Claims, 8 Drawing Sheets

(56) References Cited

U.S. PATENT DOCUMENTS

Figure 1:
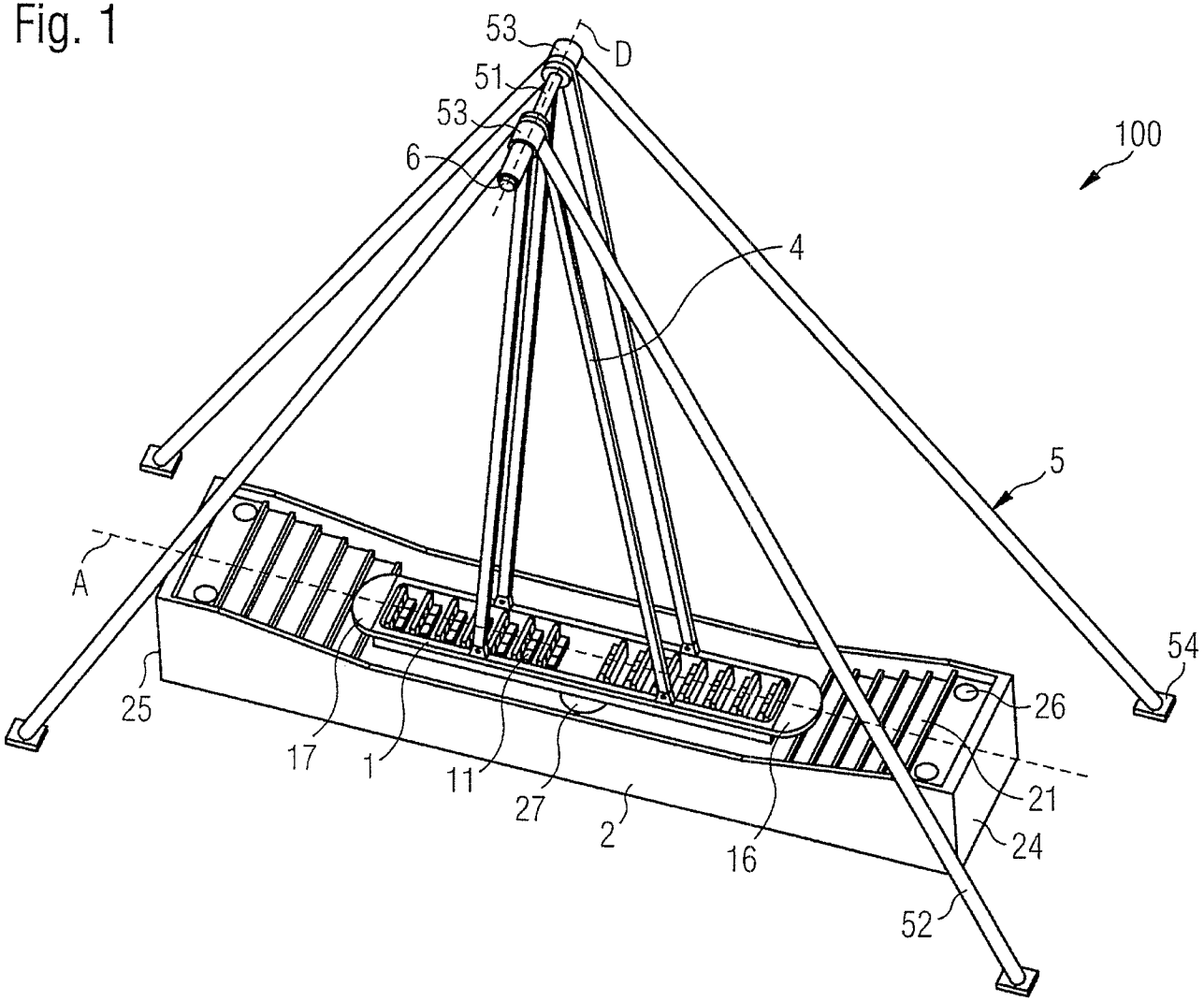

| | | | | |
|---|---|---|---|---|
| 4,960,275 | A * | 10/1990 | Magon | A63G 3/00 472/13 |
| 5,790,990 | A * | 8/1998 | Hall | E04H 4/144 4/488 |
| 5,947,828 | A * | 9/1999 | Fabbri | A63G 27/00 472/30 |
| 7,156,714 | B2 * | 1/2007 | Kian | A63C 19/00 104/173.1 |
| 7,988,562 | B2 * | 8/2011 | Kojiro | A63G 27/00 472/13 |
| 8,083,599 | B2 | 12/2011 | Crawford et al. | |
| 2010/0009767 | A1 | 1/2010 | Crawford et al. | |
| 2016/0243451 | A1 | 8/2016 | Burger | |
| 2016/0325189 | A1 | 11/2016 | Sornik et al. | |
| 2017/0333800 | A1 * | 11/2017 | Zamperla | A63G 31/007 |
| 2019/0270024 | A1 * | 9/2019 | Morosini | A63G 7/00 |

FOREIGN PATENT DOCUMENTS

| | | | |
|---|---|---|---|
| DE | 9410114 | U1 | 9/1994 |
| DE | 102013222910 | A1 | 5/2015 |
| DE | 102014103226 | A1 | 9/2015 |
| EP | 1524016 | A1 | 4/2005 |
| WO | 2004/041380 | A1 | 5/2004 |

OTHER PUBLICATIONS

Wonderla water Pendulam [Viewed on Jan. 11, 2021] Viewed on Internet. < URL: https://www.youtube.com/watch?v=BsRqBUiYkyY >, Published on Jun. 26, 2010.

Chinese office action dated Mar. 29, 2021, for corresponding application No. 201880069943.6.

Canadian Office Action dated May 26, 2021, for corresponding application CA 3,077,264.

* cited by examiner

AMUSEMENT RIDE

This is a National Phase Application filed under 35 U.S.C. 371 as a national stage of PCT/EP2018/068865, filed Jul. 12, 2018, an application claiming the benefit of German Application No. 102017125288.6, filed Oct. 27, 2017, the content of each of which is hereby incorporated by reference in its entirety.

The invention relates to amusement ride according to the features of the preamble of claim 1.

The invention relates in particular to amusement rides having an amusement ride which travels at least once through a liquid, for example, water. Such water amusement rides are very popular in the summer, when it is hot. Traveling into the water offers a refreshing experience and increases the level of fun, in particular if the vehicle is guided from above into the water and thus generates the very popular splash effect upon contact with the water.

DE 10 2014 103 226 A1 of the applicant describes, for example, a water amusement ride having a water vehicle which can travel along a route having rails. A first water pool is provided on the route, which can be filled with water and through which the vehicle is guided. The pool has either a low level or a zero level, or a high level. Further pools are provided, which are connected to the first water pool by lock gates. The water vehicle is firstly accelerated along the route at low level, the lock gates are then opened, so that the water level of the first water pool rises to the high water level. The vehicle is then guided into the first water pool having high water level to thus generate the popular splash or water spray.

In this amusement ride, the vehicle continuously has to be controlled using drives. In particular, linear drives have to be used to brake the vehicle. This is because it is known that when the vehicle runs through the water, it is strongly braked. The pool can therefore only be filled with water at a high level at the end of the trip. The braking on the basis of the water alone can only be controlled with difficulty in this amusement ride, however, so that further braking means are necessary.

The freedom of movement and the speed of the vehicle are additionally strongly limited on such a route guide.

The object of the invention is therefore to provide an amusement ride in which the vehicle is freer in its movement and which still offers even more fun.

This object is achieved by an amusement ride having the features of claim 1.

Refinements of the invention are the subject matter of the dependent claims.

The amusement ride according to the invention comprises at least one vehicle, which comprises one or more passenger compartments for accommodating passengers, and a pool, wherein the amusement ride is designed in such a way that at least one pendulum movement of the vehicle is possible, and is distinguished in that the amusement ride is configured such that the pool can be at least partially filled with a liquid and the vehicle comes into contact with the liquid of the pool in the course of the pendulum movement.

The amusement ride is accordingly embodied as a giant pendulum, i.e., the vehicle is fastened in such a way that its center of gravity can swing around an idle position. The vehicle can move in a majority of directions because the vehicle is no longer necessarily bound to rails or other guide means. In the course of the pendulum movement, the vehicle is then guided over the pool filled with liquid. A water effect can thus be generated.

The contact of the vehicle with the liquid of the pool results due to a relative movement of the two. The contact does not have to take place during each traversal of the pool because of the strong deceleration effect of the liquid. Rather, a minimum distance between the vehicle, on the one hand, and the liquid or the pool, on the other hand, can be varied in the course of the pendulum movement. A fill level of the pool can be varied during the trip for this purpose. The fill level in the pool can also remain constant and the distance of the vehicle in relation to the pool can be changed during the trip. It is important that in the course of the pendulum movement of the vehicle, an overlap of a movement radius of the vehicle with the liquid occurs at least once.

According to one particularly advantageous embodiment, the pool comprises at least one section, over which the liquid can flow, wherein means are provided using which a flow rate of the liquid on the section of the pool can be varied arbitrarily.

The liquid thus flows within the pool over the section, which can be arranged at an edge of the pool, down to a base of the pool. While the pool in the prior art only has two levels, the flow rate of the liquid, and thus also a fill level of the pool, can be varied arbitrarily according to the invention, so that when the vehicle travels above or through the liquid, both the deceleration effect of the liquid and also the splash effect can be controlled. The degree of pleasure of the amusement ride can thus be set in dependence on the public. Particularly large bow waves can be generated in this case. It is also conceivable that no liquid flows over the section at the beginning of the trip, and the liquid is only gradually introduced over the section into the pool, so that the bow waves become larger and larger during the travel of the vehicle in the pool, or vice versa. Further braking means can be omitted by the vehicle being able to be braked in a controlled manner using the liquid of the pool. It is important in particular that the loss of liquid in the pool linked to the splash effect can be compensated for on the basis of the means for varying the flow rate of the liquid. This has the result that the vehicle can generate a splash effect during each traversal. This is not the case with conventional water amusement rides. For this purpose it is conceivable, for example, that the deceleration effect of the liquid during the passage of the filled pool is compensated for using a drive, which accelerates the vehicle after passing the liquid, so that the vehicle can travel arbitrarily many transits having splash effect.

The vehicle is released from a high position with switched-off drive and can swing solely by means of the acceleration of gravity, wherein every time that the vehicle travels through the liquid of the pool, it is decelerated until it comes to its idle state. No further drives are required for this purpose, since the vehicle no longer travels on a rail and the fill level of the liquid in the pool is selected or refilled in such a way that an idle state can be achieved within a desired time. The amusement ride is therefore particularly energy-saving and requires fewer parts.

The vehicle is preferably rotatably mounted on a fastening element, for example, via at least one rod. The vehicle thus has one to three rotational degrees of freedom, depending on the type of the connection between the fastening element and the vehicle. This type of mounting actually corresponds to the arrangement of a pendulum. The vehicle can thus move freely around the fastening element along a spherical surface and can therefore have a plurality of movement options. The fastening element can be formed, for example, as a rod or as a ball element. Therefore, tracks are no longer required for the vehicle, but rather only a support structure for the fastening element is required, which substantially facilitates the arrangement of the amusement ride. This also means that the vehicle stands almost freely in space, which is particularly exciting for the passengers.

According to one preferred embodiment, the amusement ride is designed in such a way that in addition to a pendulum movement, at least one further movement of the vehicle and/or the one or more passenger compartments of the vehicle is possible. With the proliferation of the possible movements of the vehicle and/or the passenger compartments, even more complex routes and movements can be developed, which offers a higher level of flexibility in the selection of the routes and movements. Moreover, passengers are always on the search for new impressions and experiences, which can be fulfilled using the amusement ride according to the invention.

In particular, the vehicle and/or the one or more passenger compartments of the vehicle can rotate around themselves. Since the vehicle already rotates around the fastening element, the passenger is particularly confused by these multiple rotations, up to the point that he no longer knows where precisely he is located in space. This confusion substantially contributes to the fun during the trip.

According to one particularly simple embodiment, the vehicle swings between two end positions. Swinging is considered here to be a special type of pendulum movement, namely the pendulum movement of a thread pendulum. In this case, the movement of the vehicle around the fastening element is restricted, so that the center of gravity of the vehicle can only travel along a circular surface. The center of gravity of the vehicle thus travels within a single plane. The amusement ride then functions like a boat swing. These end positions are preferably arranged symmetrically in relation to a plane of the fastening element. The vehicle can be moved via a drive up to the first end position and then can be released to swing with decoupled drive up to the second end position, where the drive is switched on again, and so on. A particularly high speed can thus be achieved by means of the acceleration of gravity, without switching on the drive. In particular hydraulic drives, electric motors, and LSM motors come into consideration as the drive. It thus has to be understood that the swinging between the end positions only forms a part of the overall trip, namely the main part. During the remainder of the trip, the vehicle only swings between positions which are arranged lower than the end positions, since the vehicle does not have enough energy to reach the end positions.

To further enhance the fun of the passengers, the amusement ride can be designed so that a 360° rotation of the vehicle around the fastening element is possible. Such upside-down trips are very popular, since the passenger themselves are placed upside down for a short time. The vehicle can then be rotated multiple times around the fastening element on the route, for example.

Means are preferably also provided to restrict or shut down individual movement directions of the vehicle and/or the one or more passenger compartments of the vehicle. These means can be in particular brakes, clutches, positioning motors, or locking cylinders. This is because the amusement ride according to the invention has a high number of movement options. However, all movement options are frequently not required. It can also be that one only wishes to switch on certain movements from or up to a particular point in time. Using these means, only desired movements can then be permitted, which ensures a higher level of control of the trip. Moreover, these means offer an enhanced level of safety. In addition, a loading and unloading position of the amusement ride can be fixed using these means, so that safe entry and exit are ensured.

To improve the travel experience, the amusement ride can be designed so that the vehicle can generate a splash or other liquid effects. The splash involves spraying of liquid out of the pool. The splash can make the passengers of the vehicle and/or the spectators of the amusement ride wet. Such a liquid effect is generated in particular when the vehicle travels at sufficient speed into the liquid flowing over the section of the pool. This thus presumes that the means for varying the flow rate of the liquid are set in such a way that sufficient liquid flows. Inter alia, bow waves are then generated, which the passengers enjoy greatly.

It is particularly preferable if the vehicle itself is designed in such a way that it can maximize liquid effects. The vehicle can comprise, for example, a preferably hemispherical element on a lower side, which displaces the liquid out of the pool as it plunges into the liquid. The vehicle thus acts like a type of hammer, which strikes the liquid of the pool.

According to one particularly advantageous embodiment, the vehicle comprises means for carrying along the liquid, which are preferably arranged on a lower side of the vehicle. In particular, the vehicle can comprise a carrier on the base, which is designed, for example, as a housing open to the front. As the vehicle travels into the pool, the housing of the vehicle thus carries along liquid through its open end. After the vehicle has traveled out of the pool and is on the return, the carrier can then let the water spray outward, for example, onto happy spectators. The distribution can have different strengths depending on the movement and speed.

It is particularly advantageous if the section of the pool over which the liquid can flow comprises a ramp or a stair, which is preferably arranged at an edge of the pool. In addition, the section can be connected to the means, using which a flow rate of the liquid can be varied arbitrarily. By the liquid flowing over the ramp or the stair into the pool, a type of waterfall is formed which makes the travel experience even more adventurous and refreshing. If the vehicle travels over the stair or the ramp with running liquid, a particularly strong and impressive splash effect can be generated. In particular, the means for varying the flow rate of the liquid are driven in such a way that the liquid level on the section is higher than a movement radius of the vehicle, so that an overlap of the liquid and the path of the vehicle results.

A dynamic and closed liquid cycle can be formed in that the means, using which the flow rate of the liquid can be varied, comprise at least one pump and one reservoir. The liquid can then, for example, be pumped out of the reservoir by the pump and then run over the section of the pool and arrive in the reservoir again. The reservoir offers the option of refilling the pool again and again and as often as necessary, so that the desired fill level in the pool or the desired flow on the section can be achieved. The liquid can flow easily and rapidly into the pool using the pump. Using these means, the flow rate of the liquid, and thus the fill level in the pool, can thus be controlled. It is also conceivable that the amusement ride comprises multiple pumps or nozzles, which are arranged and designed in such a way that the liquid can be conveyed from the reservoir by the pumps sufficiently high that the provided flow partially overlaps the path of the vehicle. A water effect is thus generated.

In order that the vehicle can be accelerated, the amusement ride can comprise one or more drives, in particular LSM (linear synchronous motor) stators, using which the vehicle can be driven. LSM stators are very widespread and can reach high speeds. The drive or drives can be arranged on the vehicle itself, on the pool, or on the support structure.

In order that the passengers can have access to the passenger compartments, means can be provided which form a loading and unloading platform at a standstill, for example, in the form of a turntable.

The passenger compartments of the vehicle are preferably arranged in a circle. This design is particularly advantageous if the entire vehicle or only one element of the vehicle, which comprises the passenger compartments, can rotate around itself.

The vehicle can be designed as a boat. This design is preferable in the case of a swinging movement, since then the vehicle forms a giant swing, which is particularly simple to accelerate in a certain direction. With its front and rear ends, the boat can effectively press the liquid away in both directions to generate the mentioned "splash effect".

Figure 2:
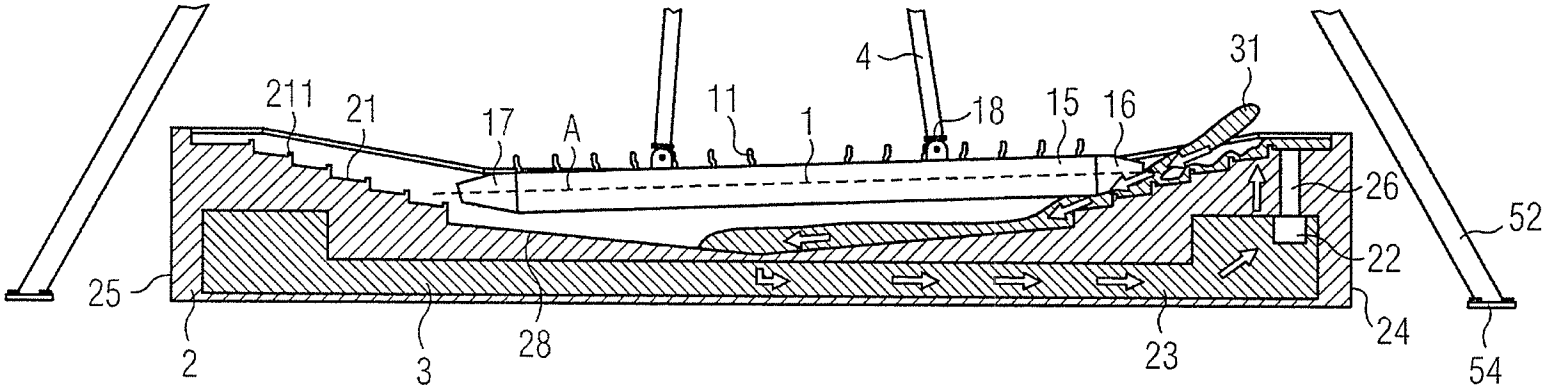
Figure 3:
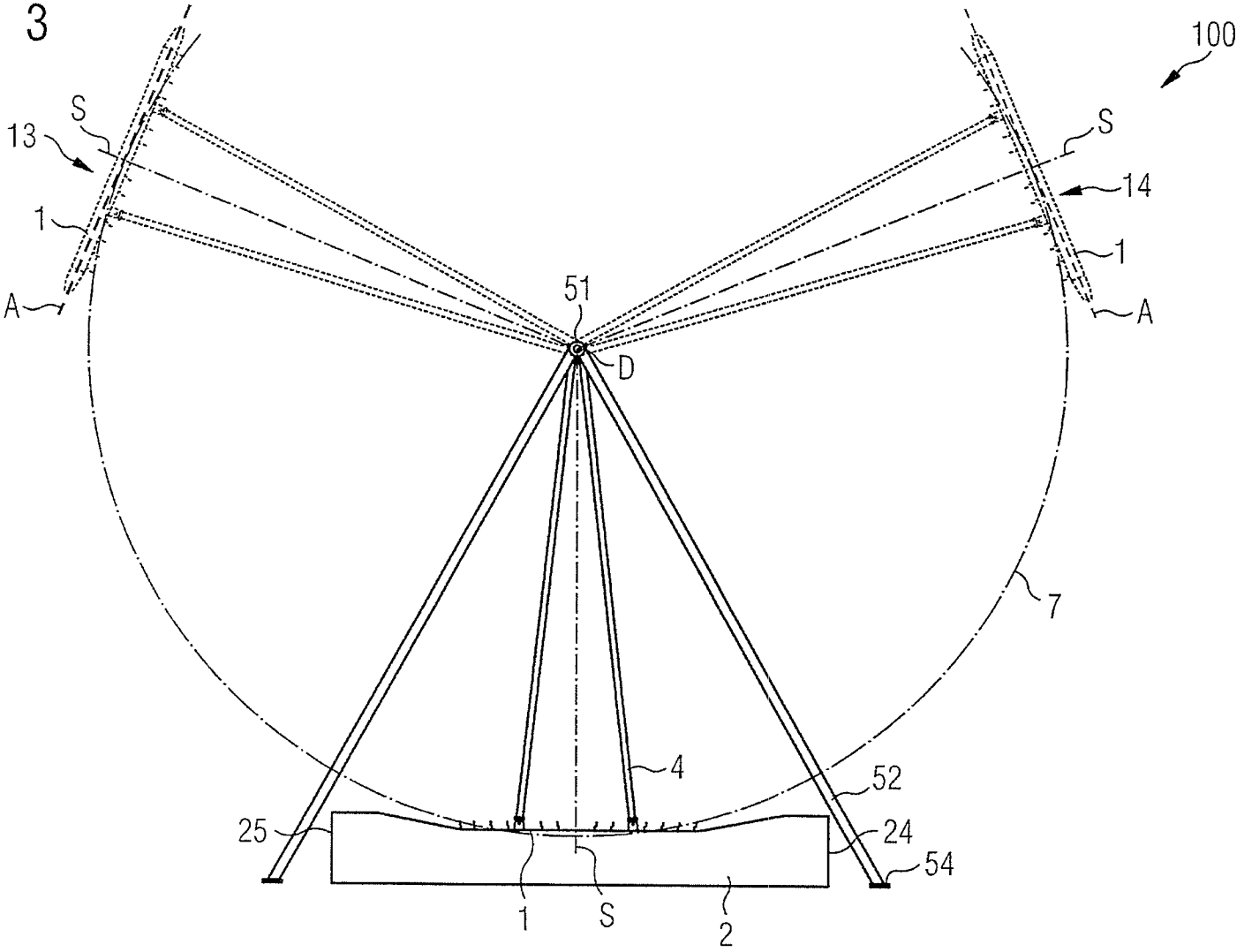
Figure 4:
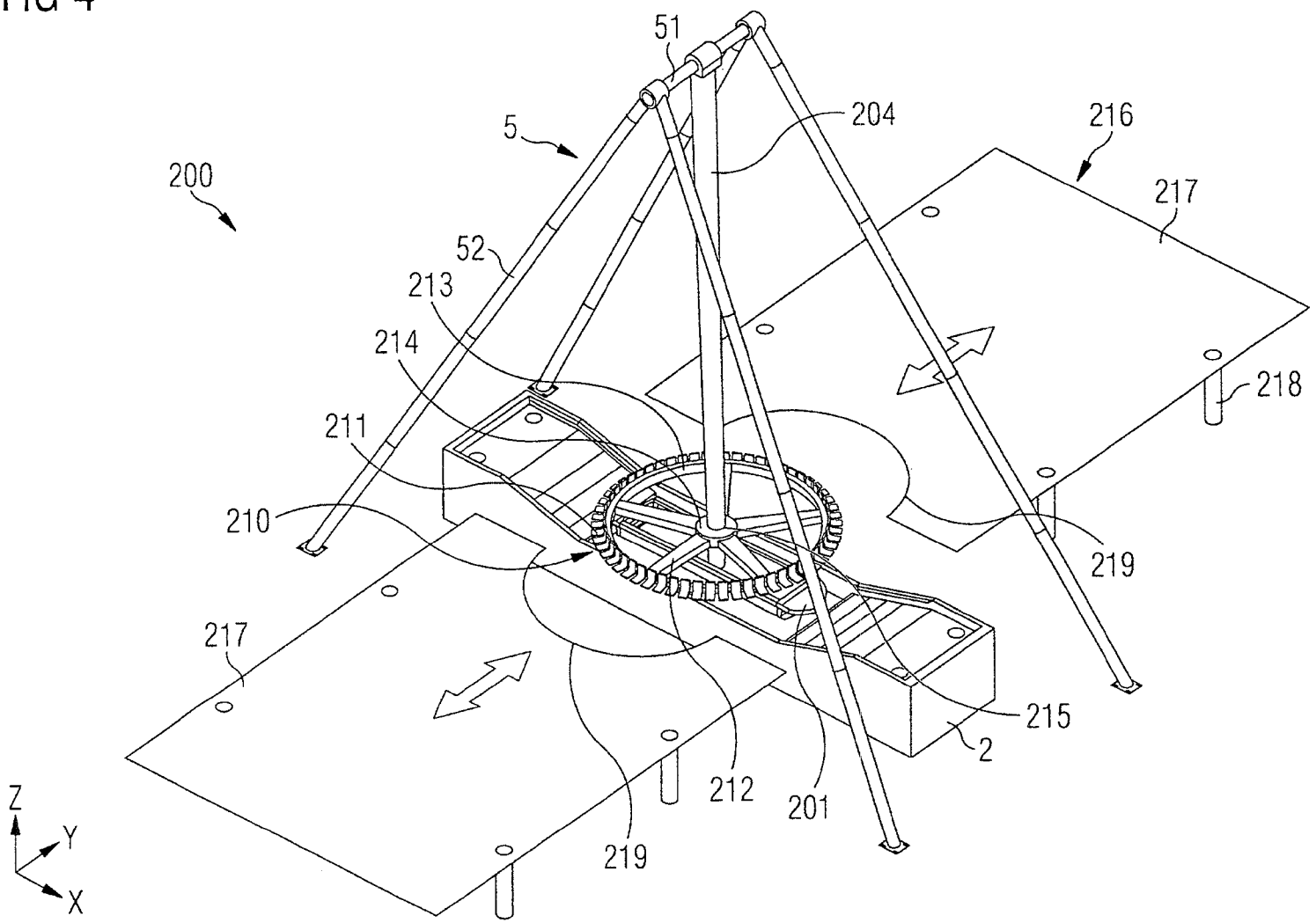
Figure 5:
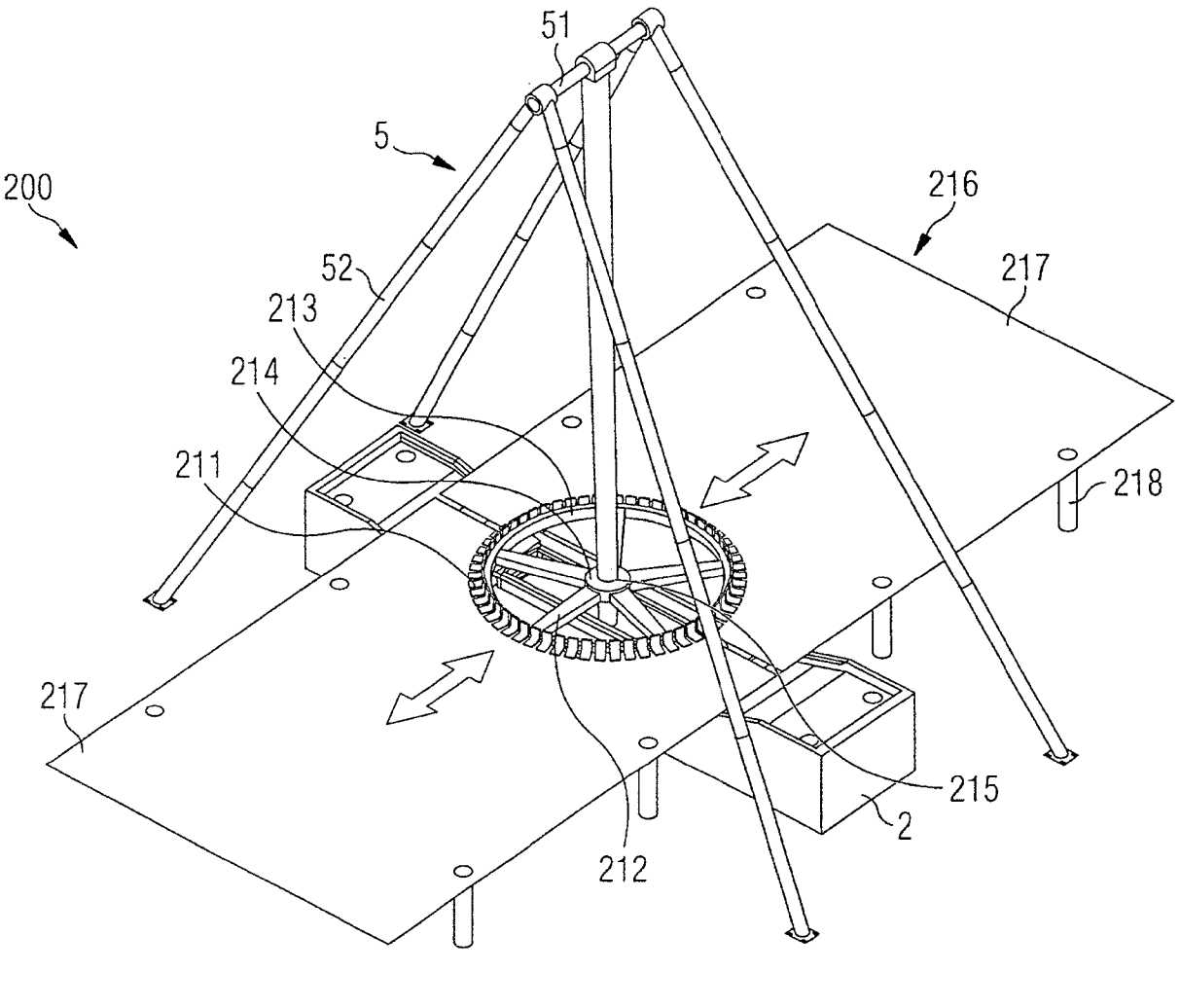
Figure 6B:
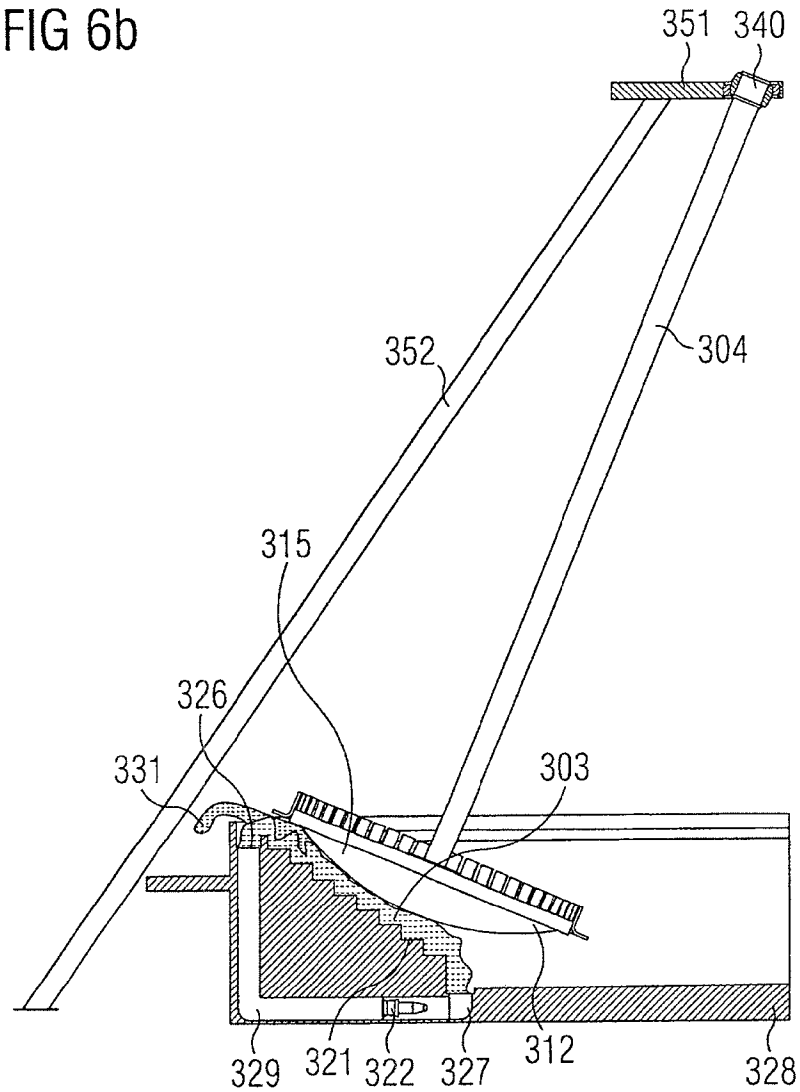
Figure 6A:
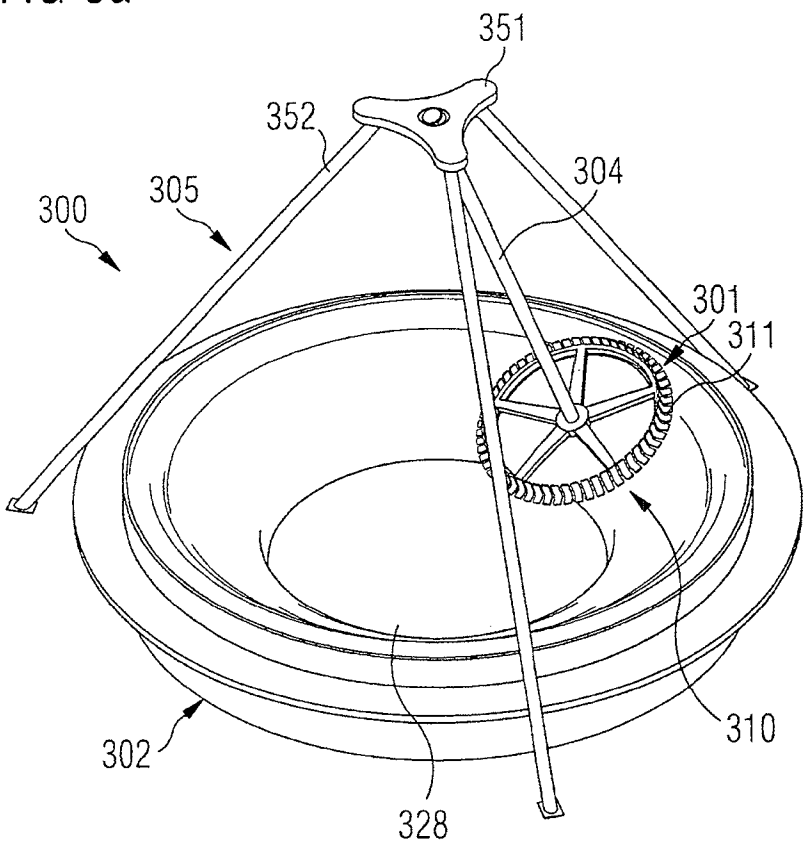
Figure 7:
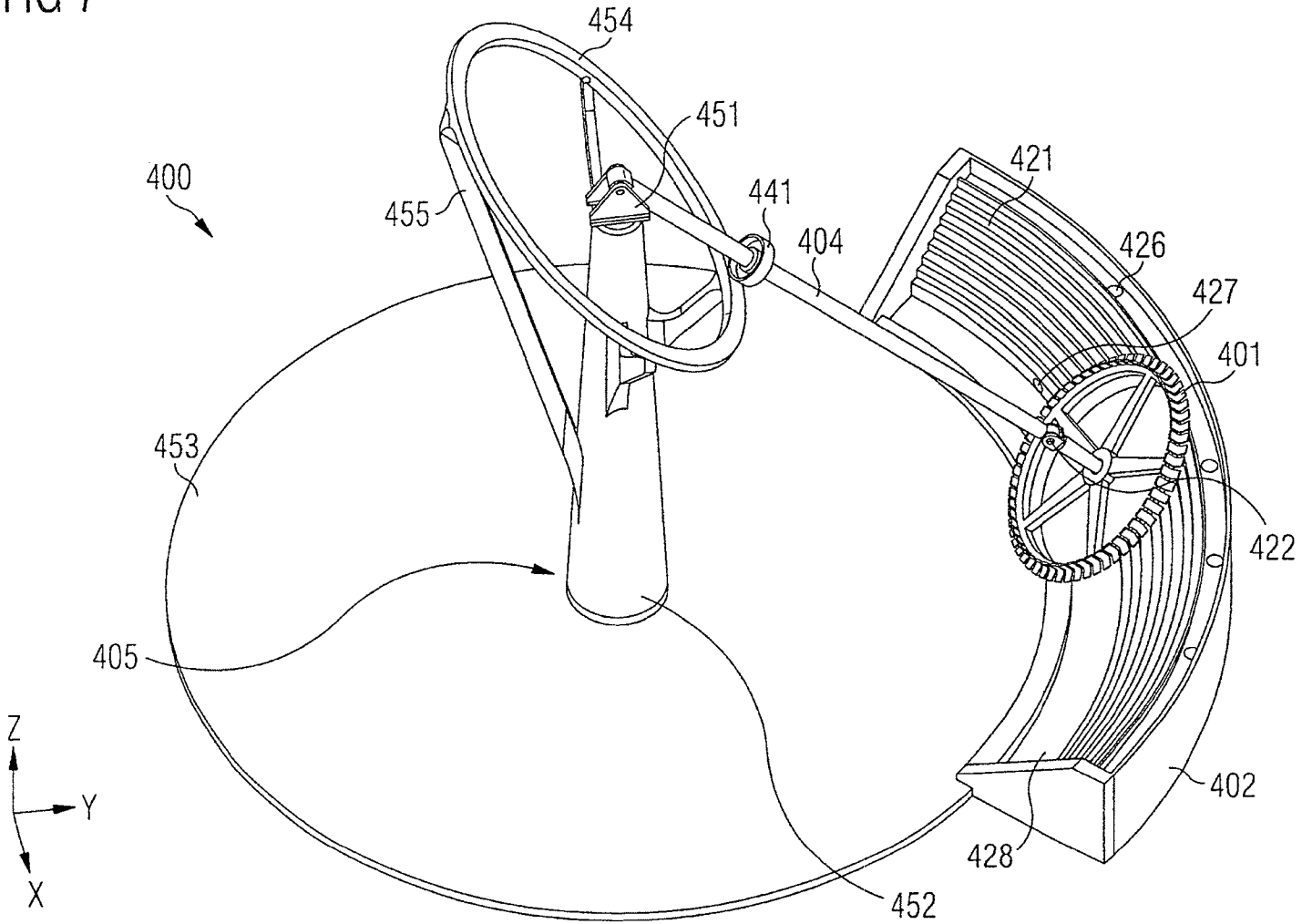
Figure 8B:
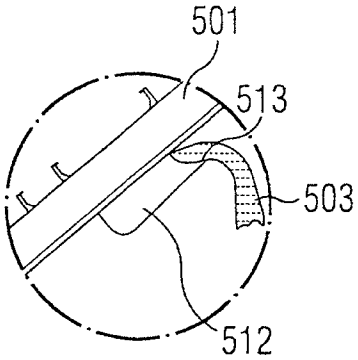
Figure 8A:
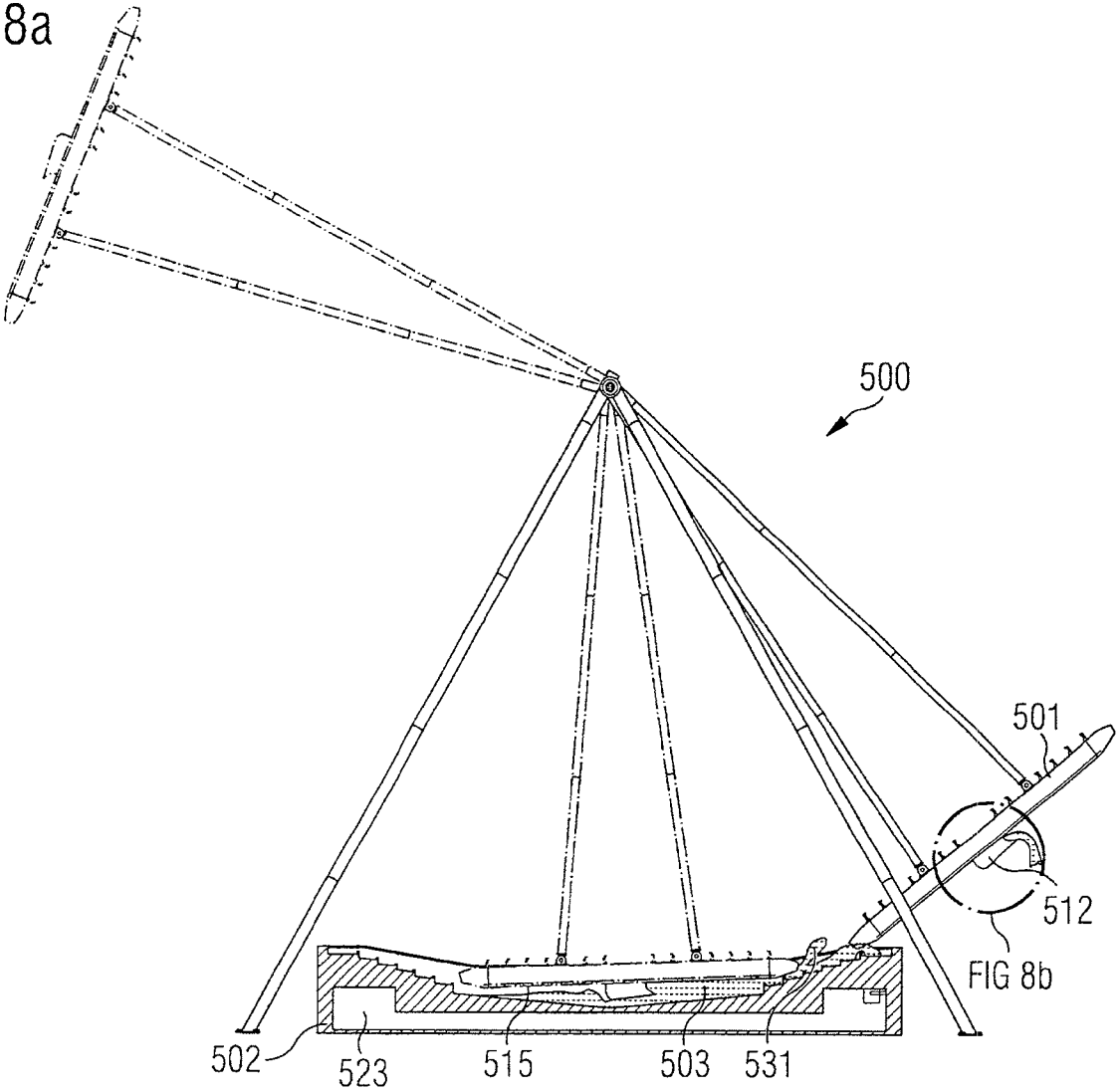

The amusement ride according to the present invention is explained in greater detail hereafter on the basis of five exemplary embodiments with reference to the appended figures. In the figures:

FIG. 1 shows a first exemplary embodiment of an amusement ride in a perspective illustration and in an idle state, FIG. 2 shows a detail view of a cross section of the amusement ride of FIG. 1 during a trip, FIG. 3 shows a side view of the amusement ride of FIG. 1 with various positions of the vehicle, FIG. 4 shows a second exemplary embodiment of an amusement ride in a perspective illustration, FIG. 5 shows the perspective illustration of FIG. 4 with loading or unloading platform, FIG. 6*a* shows a third exemplary embodiment of an amusement ride in a perspective illustration, FIG. 6*b* shows a detail view in cross section of the amusement ride of FIG. 6*a*, FIG. 7 shows a fourth exemplary embodiment of an amusement ride in a perspective illustration, FIG. 8*a* shows a fifth exemplary embodiment of an amusement ride in a side view in an idle state and with moving vehicle, and FIG. 8*b* shows a detail view of the amusement ride of FIG. 8*a* with moving vehicle.

In the following figures, if not indicated otherwise, identical reference signs identify identical parts having identical meaning.

FIGS. 1 to 3 show a first example of an amusement ride 100. The amusement ride 100 comprises a vehicle 1, a pool 2, and a support structure 5 and functions as a swing ride.

FIG. 1 shows the amusement ride 100 in an idle state and with empty pool 2. The vehicle 1 is designed as a boat having a housing, which extends along an axis A of the vehicle 1 and in which a plurality of passenger compartments 11 for accommodating a passenger (not shown in greater detail) in each case are attached. The passenger compartments 11 are arranged in rows and designed as seats. In the present case, the vehicle 1 comprises 56 seats. The vehicle 1 comprises a first end 16, which is arranged at the front, and a second end 17, arranged opposite to the first end 16, which is arranged at the rear. The vehicle 1 additionally comprises a plurality of essentially semicircular fastening elements 18 at edges of an upper side for fastening of the vehicle 1 on the support structure 5, which are arranged symmetrically in relation to the axis A.

The support structure 5 comprises a fastening element 51, which is formed as a rod having an axis D, and support elements 52, which connect the fastening element 51 to a base (not shown in greater detail), in such a way that the fastening element 51 is securely and solidly connected to the base. The two support elements 52 are formed V-shaped in the present case having two linear rods connected to one another, which form a receptacle 53 for the fastening element 51 at a connecting point and are solidly screwed onto the base or a transportable platform at ends 54. The support elements 52 can be designed as telescopic, so that a distance between the base of the platform and the fastening element 51 can be varied. In addition, a drive 6 for driving the vehicle 1 is arranged laterally on the receptacle 53 in the fastening element 51. In the present case, this is an electric motor. The support structure 5 is manufactured substantially from steel in the present example.

The vehicle 1 is connected to the fastening element 51 of the support structure 5 by a plurality of support elements 4, in the present case two. The support elements 4 comprise two rods, which have an acute angle in relation to one another. The rods form an eye for accommodating the fastening element 51 at a connecting point, so that the support elements 4 are movably arranged on the fastening element 51, namely around the axis D of the fastening element 51. The support elements 4 additionally each comprise two ends, which are each connected to a connecting element 18 of the vehicle 1. The rods are rigid and thus define a fixed distance between the vehicle 1 and the fastening element 51 of the support structure 5. It is also conceivable that the support elements are formed as single rods, which are fixedly connected to the connecting element.

The vehicle 1 thus forms, together with the support structure 5, a swing ride, which floats over the ground. The vehicle 1 can rotate around the axis D of the fastening element 51, while further movements of the vehicle 1 in relation to the fastening element 51 are not permitted.

The pool 2 is arranged on the base. The pool 2 comprises a substantially rectangular footprint, which extends along a longitudinal axis, which runs in parallel to the axis A of the vehicle when the vehicle 1 is in an idle state, as is the case in FIG. 1.

FIG. 2 shows a cross section of the amusement ride 100 of FIG. 1 through a plane which extends perpendicularly to the axis D of the fastening element 51. The pool 2 is formed symmetrically in relation to a plane which extends perpendicularly to the longitudinal axis of the pool 2 and through an axial center of the pool. The pool 2 comprises a first end 24 arranged at the front and a second end 25 arranged at the rear. Viewed axially, proceeding from the end 24 in the direction of the end 25, the pool 2 comprises a first section, which comprises a plurality of stairs 21 leading downward, i.e., in the direction of the base, over which a liquid 3 can flow, and a second section 28, which is formed slightly inclined and leads downward to the center of the pool 2, so that it forms a base of the pool 2. The stairs 21 are formed inclined downward having an upwardly facing projection 211, which slightly obstructs a flow of a liquid over the stairs 21. In the present case, the pool 2 is formed so that the vehicle 1 can be arranged in the idle state between the front and the rear stairs 21 of the pool 2, as can be seen clearly in FIG. 1. It is also conceivable that the pool 2 comprises a ramp, which can also be used for liquid guiding, instead of stairs 21. A reservoir 23, which accommodates nearly the entire footprint of the pool 2 and can be filled with the liquid 3, is arranged inside the pool 2. In FIG. 2, the reservoir 2 is completely filled with the liquid 3. In the present case, the liquid is water, but it is also conceivable to use other liquids. The pool 2 comprises a plurality of pumps 22 arranged at the end, in the present case four, which can pump the liquid 3 out of the reservoir 23 and convey it outward through upwardly facing openings 26 of the pool. In addition, the pool 2 comprises a central opening 27 at the center, through which the liquid 3 can be returned back into the reservoir 23. If the liquid 3 is fired outward from the reservoir 23, it then runs like a waterfall over the stairs 21 leading outward, and then over the second, inclined section 28 of the pool 2. The liquid 3 can then return into the reservoir 23 via the central opening 27. This circulating movement of the liquid 3 is illustrated by arrows in FIG. 2.

FIG. 3 shows a side view of the amusement ride 100 in a plane which extends perpendicularly to the axis D of the fastening element 51. FIG. 3 shows the vehicle 1 in solid lines when it is located in an idle state according to FIG. 1, and also in a first end position 13 and a second end position 14, which are shown by dashed lines. The movement of the vehicle 1 around the axis D of the fastening element 51 of the support structure 5 is clear in FIG. 3. A center of gravity S of the vehicle 1 moves on a circle 7, which extends in a plane which is perpendicular to the axis D of the support structure 5. The vehicle 1 can thus swing between the end position 13 and the end position 14, wherein the end positions 13, 14 are formed symmetrically in relation to the center, radial plane of the pool 2. In the present case, the vehicle 1 reaches a height of approximately 40 m in an end position 13, 14. It is also conceivable that the vehicle 1 can rotate around 360° and can thus move on the entire circle 7. The pool 2 is arranged so that the vehicle 1 travels over the pool 2 in one route section on the route between the end positions 13, 14 and is guided through the liquid 3 when the liquid runs on the stairs 21 and the second section 28.

A trip of the vehicle 1 takes place as follows. Firstly, the vehicle 1 is located in a starting position, which is shown in FIG. 1. The vehicle 1 is accelerated along the circle 7 on the basis of the drive 6, which is arranged in the fastening element 51, and swings until it reaches the end position 13. This acceleration takes place via multiple levels, in which a higher and higher position is reached. The total duration of the acceleration is not more than 100 seconds. When the vehicle 1 is located in the end position 14, the main phase begins: the drive 6 is decoupled and it swings by means of the acceleration of gravity in the direction of the end position 13 at a maximum speed of 100 km/h. The maximum acceleration in the direction of the ground is 5 g. To reach the end position 13, the drive is then switched on again. The vehicle 1 then enters the end phase: the drive is decoupled and the vehicle 1 swings in the direction of the other end position 14 due to the acceleration of gravity. The two frontally arranged pumps 22 are switched on so that the liquid 3 runs out of the reservoir 23 over the stairs 21 and the second section 28. The pumps 22 are driven in such a way that the provided flow overlaps the runway of the vehicle 1 on at least one section of the runway. The pumps 22 can also be controlled so that they convey the liquid 3 high enough that the provided liquid jets intersect the route course of the vehicle 1. It is important that only the pumps 22 which are arranged axially opposite to the position of the vehicle 1 are switched on. Because of the strong deceleration effect of the liquid 3, the pumps 22 are only supposed to be switched on at the end of the trip. Instead of pumps, similar liquid conveyance means can also be used, for example, nozzles. The vehicle 1 then travels with its front end 16 through the provided flow and thus generates a water effect 31, which is formed in the present case as a bow wave. This situation is shown in FIG. 2. The front pumps 22 are then stopped and the rear pumps 22 are switched on. When the vehicle 1 swings back in the direction of the end position 13, it meets the new flow over the rear stairs 21. Upon meeting the running liquid 3, not only is a water effect 31 generated, but rather the liquid 3 also decelerates the vehicle 1. Since the drive 6 is decoupled in the end phase, the vehicle 1 travels slower and slower and reaches lower and lower positions. In the present case, the pumps 22 are only switched on during the last back and forth trip of the vehicle 1. Finally, the decelerated vehicle 1 is moved into the starting position by the drive 6. More than 1000 passengers per hour can travel using the amusement ride 100.

The traveled route and the switching on of the pumps 22 can obviously be selected as desired. In particular, the fill level of the liquid 3 in the pool 2 does not have to be changed during the pendulum movement. This is because it is also conceivable that during the trip, a distance of the vehicle 1 in relation to the pool 2 is changed, for example, by way of a change of the length of the elements 52 or 4, if they are designed as telescopic. The vehicle 1 is thus plunged into the liquid 3 already present in the pool 2.

FIGS. 4 and 5 show a second example of an amusement ride 200 having a vehicle 201, wherein the vehicle 201 is at a standstill. The amusement ride 200 comprises the same support structure 5 and the same pool 2 as the amusement ride 100 of FIG. 1 and primarily differs from the amusement ride 100 of FIGS. 1 to 3 in that the passenger compartments 211 are not arranged in rows in the vehicle, but rather in the circle on a wheel 210.

The vehicle 201 is designed as an oblong boat and additionally comprises the wheel 210, which is connected to the boat by a rod 204. The rod 204 connects a center of the boat to the fastening element 51, in such a way that the vehicle 201 can swing around the axis D of the fastening element 51. The wheel 210 comprises a rim 211 and a hub 214, which are connected to one another via a plurality of spokes 212, five in the present case. The passenger compartments 211 are arranged in a circle on the rim 213. In the present case, the wheel 210 can accommodate 56 passengers. The hub 214 comprises an opening 215 for accommodating the rod 204. The wheel 210 is thus placed through the opening 215 on the rod 204 in such a way that the wheel 210 can rotate around an axis of the rod 204. In the present case, the wheel 210 is fixedly arranged on the rod 204 and the rod 204 is designed so that it can itself rotate. It is also conceivable that the rod is arranged rotationally fixed and the wheel 210 can rotate around the rod 204 by way of a drive. The rotation of the wheel 210 forms an additional movement of the passenger compartments 211 in any case, so that during a trip of the vehicle 201, the vehicle 201 can swing with the wheel 210 and the wheel 210 with the passenger compartments 211 can rotate around the axis of the rod 204 independently of the swinging movement. The travel experience for the passengers becomes much more exciting with this double movement.

A platform 216 is used so that the passengers can have access to the passenger compartments 211 of the wheel 210. This platform 216 is composed of two plates 217 movable along an axis, which are designed so that when they are assembled, they form a receptacle 219 for the wheel 210. When the vehicle 201 is at a standstill, the plates 217 are moved toward one another from opposing sides until they form the platform 217 and accommodate the wheel 210. This situation is shown in FIG. 5. The movement of the plates 17 is shown by arrows in FIG. 5. The plates 217 are spaced apart from the base via columns 218, so that they are placed at the same height as the wheel 210 itself. The passengers can then run to the passenger compartments 211 over the platform 216. The wheel 210 is thus loaded and unloaded. After the loading and/or unloading of the wheel 210, the plates 217 are moved away from one another, so that the wheel 210 is released and the vehicle 201 can travel. FIG. 4 shows this.

FIGS. 6*a* and 6*b* show a third exemplary embodiment of an amusement ride 300. The amusement ride 300 comprises a vehicle 301, a pool 302, and a support structure 305 and functions like a pendulum. The vehicle 301 thus has a pendulum movement, which can be combined with a self-rotating movement.

The vehicle 301 comprises a wheel 310, which is designed precisely like the wheel 210 of FIGS. 4, 5, wherein the passenger compartments 311 are also arranged in a circle on the wheel 310 in this example. The vehicle 301 additionally comprises a hemispherical element 312 on a lower side 315 of the wheel 310, using which the vehicle 301 can "strike" the liquid 303. As in the embodiment of FIGS. 4, 5, the wheel 310 is connected at a center point to a rod 304, the axis of which always extends perpendicularly to a plane of the wheel 310. In the present case, the amusement ride 301 is arranged on the rod 304 in such a way that the amusement ride 301 can rotate around the rod 304. It is conceivable that means are provided which control this rotation, so that in particular a rotation of the vehicle 301 is only permitted from a defined point in time of the movement of the vehicle 301.

The support structure 5 is formed pyramidal having three identically formed rods 352, which are fixedly connected at one end to the base and are connected at another end to a fastening element 351. The fastening element 351 is formed essentially plate-shaped in the present case, having three arms extending outward from a center point, which are each connected to one rod 352, and a centrally arranged receptacle for the rod 304. In addition, a drive (not shown in greater detail) is provided on the fastening element. However, this drive can also be arranged on the vehicle 301 itself, on the pool 302, or at other locations of the support structure 305.

The vehicle 301 is rotatably mounted on the fastening element 351. For this purpose, the rod 304 has a spherical element 340 at a free end, which is not connected to the vehicle 301, this element being accommodated by the receptacle of the fastening element 351 to form a ball and socket connection. The vehicle 3 can thus rotate around the fastening element 351 freely, i.e., in all directions. A center of gravity of the vehicle 301 can thus move on a spherical surface, the center point of which is the center point of the fastening element 351, so that a typical pendulum movement of the vehicle 301 results therefrom. The vehicle 301 thus comprises a plurality of movement options, since the vehicle 301 can rotate around itself around the rod 304, and the rod 304 can itself rotate around the connecting point between the fastening element 351 and the element 340.

The pool 302 is formed essentially circular and comprises a circular base 328 and, viewed radially in the direction of a center of the pool 302, a plurality of stairs 321 leading downward, which connect edges of the pool 302 to the base 328 of the pool 302 and over which a liquid 303 can flow. In the present case, the stairs 321 are arranged circumferentially on the base 302. In this exemplary embodiment, an interior of the pool 302, which is delimited by the base 328 and the circumferential stairs 321, forms a reservoir for the liquid 303. The interior of the pool 302 is therefore continuously filled at least partially with the liquid 303. FIG. 6*b* shows that the pool 302 comprises at least one pump 322, which conveys the liquid 303 outward via an opening 326 in the pool 302, so that it runs down over the stairs 321 down to the base 328. A waterfall is thus formed, which is formed ring-shaped in the present case and is therefore particularly impressive. At least one opening 327, which leads via a channel 329 up to the pump 322, is provided in the base 328. The pool 302 is located inside the support structure 305 and is designed so that during the pendulum movement, the vehicle 301 travels on a route section over the pool 302 and can be guided through the liquid 303 of the pool 302 when the liquid 303 runs over the stairs 321 and the base 328 of the pool 302.

A trip of the vehicle 301 takes place as follows: the vehicle 301 is accelerated by means of the drive arranged on the fastening element 351, in such a way that a pendulum movement is generated. The drive is controlled so that the vehicle 301 reaches higher and higher end positions. When the drive is decoupled, the vehicle 301 is accelerated by the acceleration of gravity. If desired, a rotation of the vehicle 301 around itself can also be switched on or off to amplify the travel experience even more. If the vehicle 301 reaches a desired end position, the at least one pump 322 can be switched on and can pump out the liquid 303 up to the stairs 321. The vehicle 301 is then guided through the liquid 303 by the acceleration of gravity. In particular, the vehicle 301 runs up over the stairs 321 filled with liquid and strikes with its hemispherical element 312 arranged on the base against the liquid 303, in such a way that a water effect 331, for example, a splash or a bow wave, is generated which can also make spectators standing on the outside wet for the greatest pleasure of the passengers of the vehicle 301 and of the spectators themselves. The situation is shown in FIG. 6*b*. In particular, it can be seen in FIG. 6*b* that the water flow is controlled in such a way that it overlaps the route traveled by the vehicle 301 at least on one section. The vehicle 301 is decelerated by the liquid 303 at the same time. In the present case, a plurality of pumps 322 is provided, which are arranged in such a way that a homogeneous water flow takes place on the circumferential stairs 321 within the pool 302. It is also conceivable that the pool 302 comprises a plurality of pumps 322, which are each responsible for one circular section of the pool 302, so that only the pump 322 is switched on which fills with liquid the section of the pool 302 through which the vehicle 301 is to travel. The vehicle 301 then travels back over the pool 302 and is further decelerated by the liquid 303 until the vehicle 301 is stationary. Precise positioning of the vehicle 301 at the starting position can be performed by the drive of the fastening element 351.

The described trip is only by way of example and can obviously be designed differently.

FIG. 7 shows a further example of an amusement ride 400 having a vehicle 401, a pool 402, and a support structure 405. The amusement ride 400 is designed in such a way that the vehicle 401 can have an elliptical and inclined movement.

The vehicle 401 is formed circular similarly as in the amusement ride 300, having a wheel and a hemispherical element (not shown in greater detail) arranged on a lower side of the wheel for ejecting liquid out of the pool 402.

The support structure 405 comprises a circular platform 453 having a column 452 arranged in a center of the platform 453 and standing perpendicular to the platform 453. The column 452 supports a ring-shaped element 454, which is arranged in a plane extending inclined in relation to a plane of the platform 453 and is connected to the column 452 by arms 455, in the present case four, which are formed integrally with the element 454 in the present case and are arranged at various locations of the column 452. In the present case, the angle between the plane of the platform 453 and the plane of the ring-shaped element 454 is fixed. However, it is also conceivable that this angle is adjustable, for example, by a telescopic formation of the arms 455 supporting the element 454. A fastening element 451 for fastening the vehicle 401 is arranged at an end of the column 453 opposite to the platform 453, in such a way that the fastening element 451 is rotatable around a longitudinal axis of the column 452. In the present case, the fastening element 451 is designed as a rotatable plate having two parallel support plates, formed essentially triangular and arranged perpendicular to the rotatable plate, between which a rod is arranged. The rod is arranged in such a way that an axis of the rod is perpendicular to the axis of the column 452.

The vehicle 401 is connected to the support structure 405 by a rod 404, which is arranged at a first end in an opening of a central hub of the wheel of the vehicle 401. The rod 404 has an eye at another end, which accommodates the rod of the fastening element 451 in such a way that the rod 404 is arranged so it is rotatable together with the vehicle 401 around the rod of the fastening element 451. In addition, a ring 441 is arranged around the rod 404, which is coaxial to the rod 404 and has a larger diameter than the rod 404. The ring 441 can interact with the ring-shaped element 454 of the support structure 405. For this purpose, the ring 441 is arranged in such a way that a circumferential surface of the ring 441 is continuously in contact with an upper surface of the ring-shaped element 454. When the fastening element 451 rotates around the axis of the column 452 due to a drive (not shown in greater detail), the rod 404 thus also rotates together with the vehicle 401, wherein the ring 441 runs on the outer surface of the ring-shaped element 454 during this rotation. The rod 441 can thus only travel on a single route, namely the circular route around a center point of the fastening element 451 determined by the ring-shaped element 454. The ring-shaped element 454 thus acts as means for restricting the movement of the rod 404. The rod 404 also comprises an articulated connection 442 in the vicinity of the vehicle 401, so that the vehicle 401 can rotate around an axis of the articulated connection 442. In addition, the vehicle 401 can rotate around itself. The vehicle 401 thus has three movement options: a first rotational movement around the column 452, in the plane of the circular element 454, a second rotational movement around the articulated connection 442, and a third rotational movement around itself. A complex, inclined, elliptical movement of the vehicle 401 thus results.

The pool 402 has as the basic shape a circular section having a plurality of stairs 421, which extend downward down to a base 428 of the pool 402, which is also formed in the form of a circular section. In particular, the plurality of openings 426, 427 are recognizable, through which the liquid conveyed by pumps or nozzles (not shown in greater detail) can run, in a similar functionality as in the embodiment of FIGS. 6*a*, 6*b*.

FIGS. 8*a* and 8*b* show a last example of an amusement ride 500 having a vehicle 501, pool 502, and a support structure 505. The amusement ride 500 differs from the swing ride 100 of FIG. 1 solely in that the vehicle 501 comprises a carrier 512 on a lower side 515. The carrier 512 is designed as a scoop element fastened on the lower side 525 of the vehicle 501 having an opening 513 arranged at the front for accommodating a liquid 503.

The liquid level in the pool 502 is initially low or zero at the starting position of the vehicle 501, so that liquid cannot be carried along as the vehicle 501 begins to swing. During the last transit, when the pumps are switched on and the liquid 503 runs over the stairs down to the base, the liquid level increases in the pool 502, so that when the vehicle 501 travels through the pool 502 and the liquid 503 and generates a splash effect 321, the carrier 512 accommodates liquid through the opening 513. This situation is shown in FIG. 8*a*. To rapidly increase the liquid level in the pool 502, the opening (not shown in greater detail), which connects the interior of the pool 503 to the reservoir 523, can be closed. During the return trip of the vehicle 501 in the direction of the pool 502, the liquid 503 is distributed because of the acceleration of gravity, for example, on happy spectators.

The invention is obviously not limited to the exemplary embodiments shown above and comprises in particular amusement rides which form a combination of the exemplary embodiments.

LIST OF REFERENCE SIGNS

100 amusement ride
1 vehicle
11 vehicle receptacle
110 circle
13, 14 end position
15 lower side
16, 17 end
18 fastening element
2 pool
21 stair
211 projection
22 pump
23 reservoir
24, 25 end
26 opening
27 central opening
28 section
3 liquid
31 water effect
4 support element
5 support structure
51 fastening element
52 support element
53 receptacle
54 end
6 drive
7 circle
A, D axis
S center of gravity
200 amusement ride
201 vehicle
210 wheel
211 vehicle receptacle
212 spoke
213 rim
214 hub
215 opening
216 platform
217 plate
218 column
219 receptacle
204 rod
300 amusement ride
301 vehicle
310 wheel
311 vehicle receptacle
312 hemispherical element
315 lower side
302 pool
321 stair

322 pump
326, 327 opening
328 base
329 channel
303 liquid
331 water effect
304 rod
340 spherical element
305 support structure
351 fastening element
352 rod
400 amusement ride
401 vehicle
402 pool
421 stair
426, 427 openings
428 base
404 rod
441 ring
442 articulated connection
405 support structure
451 fastening element
452 column
453 platform
454 ring-shaped element
455 arm
500 amusement ride
501 vehicle
512 carrier
513 opening
502 pool
523 reservoir
503 liquid
531 water effect
505 support structure

The invention claimed is:

1. An amusement ride (100, 200, 300, 400, 500) comprising:

at least one vehicle (1, 201, 301, 401, 501), comprising one or more passenger compartments (11, 211, 311) for accommodating passengers;

a support structure (5) comprising a fastening element (51, 351, 451) supported above a base by at least one support (52), the at least one vehicle (1, 201, 301, 401, 501) being rotatably suspended from the fastening element (51, 351, 451) by at least one support element (4, 204, 304, 404);

a pool (2, 302, 402, 502), wherein the pool (2, 302, 402, 502) is adapted to be at least partially filled with a liquid (3, 303, 503), and wherein the vehicle (1, 201, 301, 401, 501) travels under pendulum movement through rotation with respect to the fastening element (51, 351, 451) to comes into contact the liquid (3, 303, 503) in the pool (2, 302, 402, 502) in the course of the pendulum movement, and wherein the vehicle swings between two end positions (13, 14) each at a maximum height above the base.

2. The amusement ride (100, 200, 300, 400, 500) according to claim 1, wherein the pool (2, 302, 402, 502) comprises at least one section over which the liquid (3, 303, 503) flows, a flow rate of the liquid (3, 303, 503) in the at least one section of the pool (2, 302, 402, 502) being selectively variable.

3. The amusement ride (100, 200, 300, 400, 500) according to claim 2, wherein the at least one section of the pool (2, 302, 402, 502) over which the liquid (3, 303) flows comprises a ramp or stairs (21, 321, 421).

4. The amusement ride (100, 200, 300, 400, 500) according to claim 2, further comprising at least one pump (22, 322) and a reservoir (23).

5. The amusement ride (100, 200, 300, 400, 500) according to claim 1, wherein the at least one support element (4, 204, 304, 404) comprises a rod.

6. The amusement ride (200, 300, 400) according to claim 1, wherein the vehicle (201, 301, 401) rotates about two or more axes.

7. The amusement ride (200, 300, 400) according to claim 6, wherein the one or more passenger compartments (211, 311) of the vehicle (201, 301) rotate about an axis defined by the at least one support element (204, 304, 404).

8. The amusement ride (100, 200, 400, 500) according to claim 1, wherein a rotational angular span of the vehicle (1, 201, 401, 501) is 360°.

9. The amusement ride (100, 200, 300, 400, 500) according to claim 1, further comprising means for restricting or stopping movement of the vehicle (1, 201, 301, 401, 501) and/or movement of the one or more passenger compartments (11, 211, 311).

10. The amusement ride (100, 200, 300, 400, 500) according to claim 1, further comprising means for generating liquid effects (31, 331, 531) with the liquid (3, 303, 503).

11. The amusement ride (500) according to claim 1, wherein the vehicle (501) comprises means (512) for carrying a portion of the liquid (503).

12. The amusement ride (500) according to claim 11, wherein the means for carrying the portion of the liquid are located on a lower side (515) of the vehicle (501).

13. The amusement ride (100, 200, 300, 400, 500) according to claim 1, further comprising one or more drives for driving the vehicle (1, 201, 301, 401, 501).

14. The amusement ride (100, 200, 300, 400, 500) according to claim 13, wherein the one or more drives each comprise a linear synchronous motor stator.

15. The amusement ride (200) according to claim 1, further comprising a loading and unloading platform (216).

16. The amusement ride (200, 300, 400) according to claim 1, wherein the one or more passenger compartments comprises a plurality of passenger compartments (211, 311), the plurality of passenger compartments being arranged in a circle.

17. The amusement ride (100, 200, 500) according to claim 1, wherein the vehicle (1, 201, 501) is configured as a boat.

18. The amusement ride (100, 200, 300, 400, 500) according to claim 1, wherein a minimum distance between the vehicle (1, 201, 301, 401, 501) and the pool (2, 302, 402, 502) is adjustable by adjusting a length of the at least one support (52) or a length of the at least one support element (4, 204, 304, 404).

* * * * *